US005244350A

United States Patent [19]

Yang

[11] Patent Number: 5,244,350

[45] Date of Patent: Sep. 14, 1993

[54] ADJUSTABLE OIL PUMP TIMING CIRCUIT WITH PRESSURE MONITOR

[76] Inventor: Tai-Her Yang, 5-1 Taipin St., Si-Hu Town Dzan-Hwa, Taiwan

[21] Appl. No.: 722,102

[22] Filed: Jun. 27, 1991

Related U.S. Application Data

[63] Continuation-in-part of Ser. No. 431,086, Nov. 3, 1989, abandoned.

[51] Int. Cl.[5] ..... F04B 49/08

[52] U.S. Cl. ..... 417/12; 417/44; 417/63; 184/63; 184/64; 184/108

[58] Field of Search ..... 417/12, 44, 63; 184/6.3, 6.4, 6.14, 108

[56] References Cited

U.S. PATENT DOCUMENTS

| | | | |
|---|---|---|---|
| 3,663,831 | 5/1972 | Cook | 184/6.4 |
| 4,101,001 | 7/1978 | Smith | 184/6.4 |
| 4,456,432 | 6/1984 | Mannino | 417/63 |
| 4,990,057 | 2/1991 | Rollins | 417/12 |

*Primary Examiner*—Richard A. Bertsch
*Assistant Examiner*—David W. Scheuermann
*Attorney, Agent, or Firm*—Leonard Bloom

[57] ABSTRACT

A device for monitoring the output pressure of an automatic oil pump and for controlling the intermittent timing sequence of the oil pump in accordance with the output pressure. A pressure sensing switch monitors the oil injection pressure and an integral watchdog timer insures that the oil pump injection pressure reaches a saturation level before a predetermined timeout occurs.

12 Claims, 2 Drawing Sheets

ADJUSTABLE OIL PUMP TIMING CIRCUIT WITH PRESSURE MONITOR

CROSS-REFERENCE TO RELATED APPLICATION(S)

This application is a continuation-in-part of application Ser. No. 431,086 filed Nov. 3, 1989, now abandoned.

BACKGROUND OF THE INVENTION

1. Field of the invention

The present invention relates to an automatic oil pump for lubricating production machinery, and more particularly, to a circuit for monitoring the output pressure of an automatic oil pump and for controlling the timing sequence of the oil pump in accordance with the output pressure.

2. Description of the Background

Tooling and production machinery generally operate with rotary or sliding parts making frictional contact. The performance and life span of such machinery largely depends on lubrication of the rotary and sliding parts.

It is well-known that automatic oil pumps operating according to a set timing sequence are more efficient and reliable than manual lubrication. However, most machinery performs many operations involving different loading conditions. Since different load conditions on the machinery necessitate a longer or shorter pumping sequence by the automatic oil pump, conventional automatic oil pumps operate in accordance with a variable timing sequence.

The variable timing sequence may be controlled manually. However, this requires repeated adjustment of the timing sequence by the operator. Moreover, the operator is unable to detect clogged or damaged internal pump filters or parts, and damage to the machinery may result.

The timing sequence may also be varied automatically. This is preferable because operator interface is minimized. Timing controls which automatically vary the timing sequence preferably operate according to a dual pumping cycle. That is, the timing sequence is controlled by two independent timers. A first adjustable timer controls the frequency at which the intermittent oil pump begins to inject oil. A second adjustable timer controls the length of time during which oil is pumped. However, in the prior art adjustable-cycle automatic oil pumps, if the second timer is set to pump oil for too long the machinery will become saturated at a peak injection pressure. Nevertheless, the pump motor will continue to operate and energy will be wasted. If the timer is set to pump oil for too short a time the proper pressure will not be achieved and insufficient oil will be delivered. In addition, the timing control circuit will be unable to detect a malfunctioning oil pump, and power will be applied to the pump motor according to the timing sequence despite the problem.

U.S. Pat. No. 3,976,989 issued to Smith proposes a partial solution to the problem. Smith '989 discloses a timing circuit employing a pressure sensitive switch and a watchdog timer for monitoring the oil pump output. As soon as pumping begins at a normal flow-rate, the pressure of the flow closes the pressure-sensitive switch. The switch in turn activates the watchdog timer to keep track of the length of time during which pumping continues. If pumping continues for too long an interval, the timer will activate an alarm. Likewise, if the pump is broken and cannot achieve the normal flow-rate pressure, an alarm will sound. The timeout alarms are an important improvement over the prior art, however, they are the sole function of the Smith '989 device. The Smith '989 device only monitors the pump. It does not control it. Moreover, the Smith '989 device only insures that the pump attains the proper output pressure for the proper length of time. It does not insure that the pump achieves saturation pressure within a predetermined time interval.

SUMMARY OF THE INVENTION

It is, therefore, an object of the present invention to provide an adjustable-cycle oil pump timing circuit having an adjustable pressure switch (including visual pressure indicator) for monitoring the output of the oil pump and for controlling the timing sequence of the oil pump in accordance with the oil injection pressure.

It is a another object of the invention to provide an adjustable oil pump timing circuit which verifies that a predetermined oil injection pressure is attained within a set time after pumping begins for determining whether problems exist, such as choked oil passages or an exhausted oil supply, etc., and for stopping the pumping operation and/or emitting an alarm if a problem exists.

It is a further object of the invention to provide an adjustable oil pump timing circuit which sequentially performs the above-described protection function during a dual adjustable cycle timing sequence with minimal circuitry.

According to the present invention, the above-described and other objects are accomplished by providing an electric oil pump motor connected between two input power terminals, a first adjustable timer connected to one input terminal for counting a preset cycle time, normally open first timer contacts connected between the first timer and the pump motor, said first timer contacts being operated by the first timer after said preset cycle time, a pressure sensing switch provided at an output of the oil pump for sensing an oil pressure and comparing said oil pressure to a predetermined saturation pressure, the pressure sensing switch being connected between the first timer and the second terminal, normally closed pressure sensing switch contacts connected in parallel with the pressure sensing switch and operated thereby when said oil pressure equals or exceeds the saturation pressure, watchdog timing means connected between said first and second input terminals for removing power from said pump motor when said pressure sensing switch fails to operate the pressure sensing contacts within a preset timeout interval.

BRIEF DESCRIPTION OF THE DRAWINGS

Other objects, features and advantages of the present invention will become more apparent from the following detailed description of preferred embodiments and certain modifications thereof when taken together with the accompanying drawings, in which.

DETAILED DESCRIPTION OF THE PREFERRED EMBODIMENT

Figure 1:
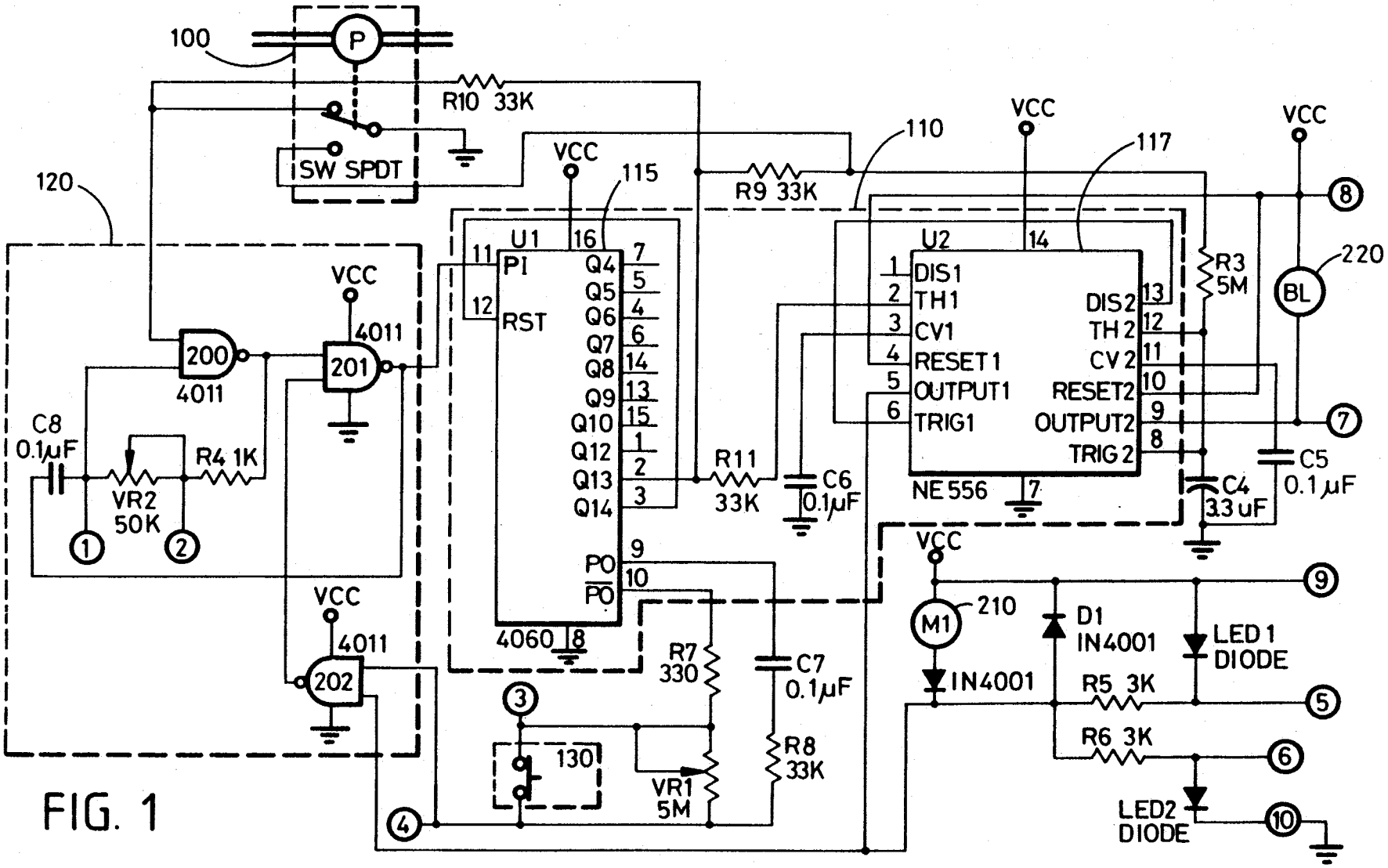
FIG. 1 is a detailed schematic diagram of an adjustable oil pump timing circuit according to the preferred embodiment of the present invention.

FIG. 1 shows a detailed schematic diagram of an adjustable oil pump timing circuit according to the preferred embodiment of the invention. The oil pump itself (not shown) may be powered by a D.C., single-phase or multi-phase electric motor. The oil injection output of the pump supplies oil to the machinery. The timing circuit according to the present invention includes a relay 21? which, when activated, applies power directly to the motor of the oil pump.

The oil pump timing sequence is controlled by adjustable timing means 110. In the preferred embodiment, timing means 110 comprises a pair of interconnected timing ICs 115 and 117. When a clock input is applied at Pl, timing IC 115 begins a ripple-count at outputs Q4–Q14. Timing IC 115 may be a National 4060, or any other timing IC capable of performing a similar function.

Timing IC 115 performs both an intermittent timing function as well as a watchdog timing function. The intermittent timing function controls the overall timing sequence for operation of the oil pump. The watchdog timing function insures that the oil pump is operating within specified time limits.

Output Q14 is connected to the reset (RST) of timing IC 115 in order to carry out the intermittent timing function. When timing IC 115 has progressed through the entire count cycle, timing IC 115 will reset itself and the count will be re-initiated. It should be noted that other outputs beside Q14 may be connected to the reset (RST) input of timing IC 115 in order to vary the length of the intermittent timing sequence.

Output Q13 is connected to pressure switch 100 and timing IC 117 in order to carry out the watchdog timing function. After a timing sequence is initiated and the oil pump begins pumping, timing IC 115 will progress through the count cycle until the count reaches Q13. If the oil pump injector output has not attained the saturation pressure prior to the count reaching Q13, then output Q13 will initiate a timeout alarm and pump motor power will be removed. The alarm may be an audio or visual alarm for signalling the operator. If the oil pump injector output has attained the saturation pressure prior to the count reaching Q13, then pressure switch 100 will trip and output Q13 will be suppressed. Neither the timeout alarm nor relay 210 will be activated, and the count will continue until timing IC 115 resets itself and re-initiates the count. It should be noted that outputs other than Q13 can be used to initiate the watchdog timing function in order to vary the time interval within which the oil pump must achieve the saturation pressure.

Outputs P0 and P0 are fed back through a manual override switch 130 to a self-oscillating clock circuit 120, which in turn provides an adjustable clocking signal to input P1 of timing IC 115. Clock circuit 120 comprises three NAND gates 200–202 such as, for example, those included in a standard 4011 integrated circuit.

Switch 130 is a conventional detent switch connected to NAND gate 202 of clock circuit 120. Switch 130 overrides the timing sequence by disabling clock circuit 120 and, at the same time, activating relay 210. When activated, relay 210 applies input power directly to pump motor M1.

A conventional pressure switch 100 is provided at the oil injection output of the oil pump for monitoring the output pressure. Pressure switch 100 converts the oil pressure to an electrical signal for comparison to a predetermined threshold level. As the oil pump operates, oil is injected to the machinery and the output pressure builds toward the saturation pressure. Pressure switch 100 compares the actual oil pressure to a predetermined threshold value which is commensurate with the saturation pressure. When the actual oil pressure exceeds the predetermined threshold, pressure switch 100 is switched open and power is removed from the oil pump. This selective pumping saves considerable energy. In addition, both pressure and comparison results may be visually displayed for indicating whether the pump is operating correctly and for allowing an operator to adjust the proper output pressure of the pump.

Pressure switch 100 is connected to NAND gate 200 of clock circuit 120 in order to disable the self-oscillating clock signal when pressure switch 100 is open (due to the actual pressure exceeding the predetermined threshold).

Timing IC 117 is optional, and is a non-essential element of the invention. However, it is a feature in the presently preferred embodiment. Timing IC 117 is a variable delay timer which may be an NE566 or any other suitable variable delay timer. Timing IC 117 is connected in series with timing IC 115 for interposing a variable delay after the occurrence of a timeout condition at timing means 115. This delay can be used as a window for further diagnostic tests before the alarm is sounded and power is removed from the pump. For instance, multiple confirming measurements of the injection pressure may be conducted during the additional delay. The delay interval can also be used as an adjustment to the intermittent pumping frequency.

The timing circuit of FIG. 1 also includes a number of test points 1–10 which may be connected to a display panel.

Figure 2:
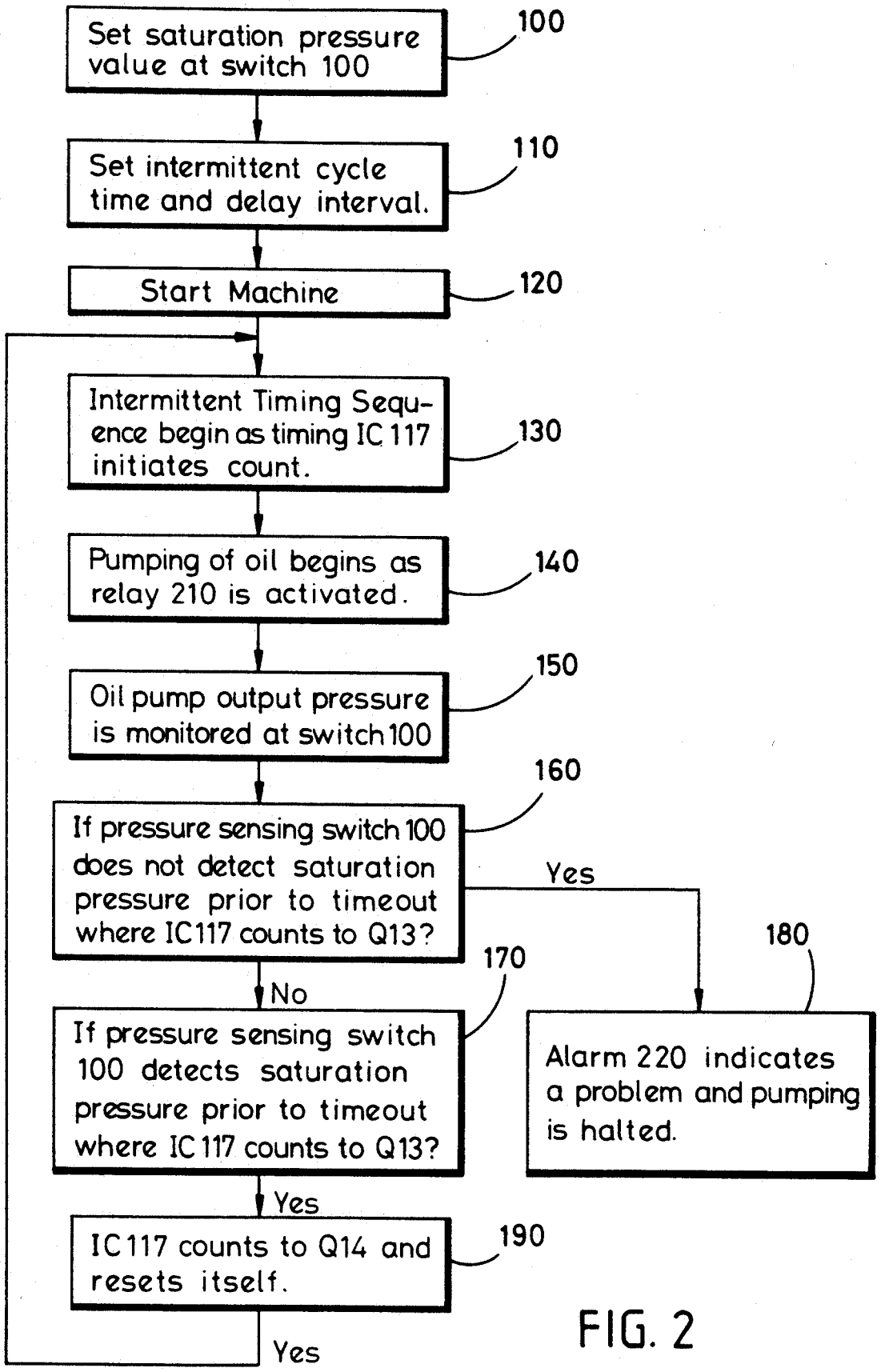
FIG. 2 is a flow diagram of the operation of the timing circuit according to FIG. 1.

The operation of the above-described timing circuit will now be described with reference to FIG. 2, which is a flow-diagram of the operation of the circuit of FIG. 1.

In step 100, pressure switch 100 is set to the saturation pressure by conventional electrical or mechanical adjustment.

In step 110, the circuit is set to the proper intermittent cycle time. This is accomplished via VR1 and VR2, both of which are variable resistors which allow adjustment of the frequency of clock circuit 120. The delay time of timing IC 117 can be varied by adjusting the values of capacitors C6 and C4.

In step 120, the machinery to be lubricated is started, and VCC power is simultaneously applied to the timing circuit.

In block 130, VCC will be applied to timing IC 115 and the intermittent timing sequence begins.

In block 140, relay 210 is activated and power is applied to the pump motor. Pumping of oil begins and the injection pressure builds at the pressure sensing switch 100.

As shown in step 150, as the pump motor begins to operate timing IC 115 continues the intermittent timing function and begins the watchdog timing function. The oil pump output function is monitored at pressure switch 100.

In step 160, if the oil injection pressure measured by pressure sensing switch 100 fails to reach the saturation level prior to timing IC 115 counting to Q13, relay 210 will be de-energized and power will be disconnected from the pump motor.

The flow diagram moves to block 180 where the alarm 220 is activated.

Otherwise, as shown in block 170, the oil injection pressure at pressure sensing switch 100 will reach the saturation level prior to timing IC 115 reaching the specified timeout interval. The pressure sensing switch 100 closes prior to a timeout occurring (where the timing IC 115 count reaches Q13).

In this case, the flow diagram moves to block 190. The count continues to Q14 where timing IC 115 resets itself. Likewise, the closure of pressure sensing switch 100 triggers timing IC 117 to institute a delay. After the predetermined delay time, timing IC 117 de-energizes relay 210 and power is removed from the pump motor.

The flow diagram then returns to block 130 where timing IC 115 continues the intermittent timing sequence with a new cycle.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

I claim:

1. A timing control and monitoring device for an oil pump, comprising:

a pressure sensing switch which may be coupled to an output of an oil pump for sensing an oil pressure output therefrom and for comparing said output pressure to a predetermined saturation pressure, said pressure sensing switch being actuated when said output pressure coincides with said saturation pressure;

intermittent timing means connected to said pressure switch for regulating power to said oil pump according to an intermittent time sequence, said intermittent time sequence including a first interval during which power is applied to said oil pump, and a second interval during which power is removed from said pump;

watchdog timing means connected to said pressure switch for measuring a timeout interval occurring during said first interval, and for detecting when said pressure sensing switch is not actuated within said timeout interval; and an alarm connected to said watchdog timing means for indicating that said pressure sensing switch has not been actuated within said timeout interval.

2. The oil pump timing control and monitoring device according to claim 1, further comprising a detent switch connected to said intermittent timing means for initializing said intermittent timing sequence.

3. The oil pump timing control and monitoring device according to claim 1, wherein said watchdog timing means further comprises a first timer for detecting when said pressure sensing switch is not actuated within said timeout interval, and a second timer serially connected to said first timer for introducing a variable delay interval between said first timer detecting that said pressure sensing switch was not actuated within said timeout interval and said alarm indication.

4. A timing control and monitoring device for an oil pump, comprising:

a pressure sensing switch which may be coupled to an output of an oil pump for sensing an oil pressure output therefrom and for comparing said output pressure to a predetermined saturation pressure, said pressure sensing switch being actuated when said output pressure coincides with said saturation pressure;

variable timing means for regulating an intermittent time sequence and a watchdog timeout interval, said timing means further comprising, a variable self-oscillating clock for supplying a clock signal of adjustable frequency, a counter connected to said clock for regulating power to said oil pump according to an intermittent time sequence, said intermittent time sequence including a first interval during which power is applied to said oil pump, and a second interval during which power is removed from said pump, said counter also regulating a timeout interval and detecting when said pressure sensing switch is not actuated within said timeout interval; and an alarm energized by said counter for indicating that said pressure sensing switch has not been actuated within said timeout interval.

5. The oil pump timing control and monitoring device according to claim 4, further comprising a detent switch connected to said self-oscillating clock for disabling said clock and applying power to said oil pump.

6. The oil pump timing control and monitoring device according to claim 4, wherein said variable self-oscillating clock further comprises a variable resistor for allowing manual adjustment of the frequency of said clock signal

7. The oil pump timing control and monitoring device according to claim 4, further comprising a variable delay timer connected between said counter and said alarm for introducing a variable delay interval between said counter detecting that said pressure sensing switch was not actuated within said timeout interval and said alarm indication thereof.

8. A timing control and monitoring device for an oil pump, comprising:

a pressure sensing switch which may be connected to an output of an oil pump for sensing an oil pressure output therefrom and for comparing said output pressure to a predetermined saturation pressure, said pressure sensing switch being actuated when said output pressure coincides with said saturation pressure;

intermittent timing means connected to said pressure switch for regulating power to said oil pump according to an intermittent time sequence, said intermittent time sequence including a first interval during which power is applied to said oil pump, and a second interval during which power is removed from said pump;

a watchdog timer connected to said pressure switch for monitoring a timeout condition in which said pressure sensing switch is not actuated within a predetermined timeout interval occurring during said first interval, said watchdog timer further comprising a first timing means for measuring said predetermined timeout interval, and second timing means serially connected to said first timing means for introducing a variable delay interval after said timeout condition; and an alarm connected to said watchdog timer for indicating said timeout condition after said variable delay interval.

9. The oil pump timing control and monitoring device according to claim 8, further comprising a detent switch connected to said intermittent timing means for initializing said intermittent timing sequence.

10. A timing control and monitoring device for an oil pump, comprising:

a pressure sensing switch which may be connected to an output of an oil pump for sensing an oil pressure output therefrom and for comparing said output pressure to a predetermined saturation pressure, said pressure sensing switch being actuated when said output pressure coincides with said saturation pressure;

variable timing means for regulating an intermittent time sequence and a watchdog timeout interval, said timing means further comprising, a variable self-oscillating clock for supplying a clock signal of adjustable frequency, a counter connected to said clock for regulating power to said oil pump according to an intermittent time sequence, said intermittent time sequence including a first interval during which power is applied to said oil pump, and a second interval during which power is removed from said pump, said counter also monitoring a timeout condition wherein said pressure sensing switch is not actuated within a preset watchdog timeout interval occurring during said first interval, a variable delay timer connected to said counter for introducing a variable delay interval after occurrence of said timeout condition; and an alarm connected to said variable delay timer for indicating said timeout condition after said variable delay.

11. The oil pump timing control and monitoring device according to claim 10, further comprising a detent switch connected to said self-oscillating clock for disabling said clock and applying power to said oil pump.

12. The oil pump timing control and monitoring device according to claim 10, wherein said variable self-oscillating clock further comprises a variable resistor for allowing manual adjustment of the frequency of said clock signal.

* * * * *